US005720082A

United States Patent [19]

Rossmo

[11] Patent Number: 5,720,082

[45] Date of Patent: Feb. 24, 1998

[54] HARDWARE FOR SWINGING PANELS

[76] Inventor: William Rossmo, 158 Mount Allison Crescent, Saskatoon Saskatchewan, Canada, S7H 4A5

[21] Appl. No.: 545,796

[22] PCT Filed: May 10, 1994

[86] PCT No.: PCT/CA94/00239

§ 371 Date: Nov. 9, 1995

§ 102(e) Date: Nov. 9, 1995

[87] PCT Pub. No.: WO94/27008

PCT Pub. Date: Nov. 24, 1994

[30] Foreign Application Priority Data

May 11, 1993 [CA] Canada ..... 2095989
Jan. 14, 1994 [CA] Canada ..... 2113537

[51] Int. Cl.[6] ..... E05D 7/04

[52] U.S. Cl. ..... 16/244; 16/248

[58] Field of Search ..... 16/243, 244, 273, 16/386; 470/906

[56] References Cited

U.S. PATENT DOCUMENTS

| | | | |
|---|---|---|---|
| 219,413 | 6/1879 | Briggs . | |
| 525,712 | 9/1894 | Knittel | 16/244 |
| 1,125,177 | 1/1915 | Rixson | 16/244 |
| 1,334,563 | 3/1920 | Shelton . | |
| 2,090,569 | 8/1937 | Bagley | 16/244 |
| 2,209,125 | 7/1940 | Lachwitz | 16/243 |
| 2,373,955 | 4/1945 | Fuller . | |
| 2,588,258 | 4/1952 | Lowman . | |
| 2,618,010 | 11/1952 | Helz | 16/244 |
| 2,779,966 | 2/1957 | Torchia | 16/244 |
| 4,305,611 | 12/1981 | Robins . | |
| 4,475,858 | 10/1984 | Benjamin et al. | 470/906 |
| 4,896,391 | 1/1990 | Rowley | 470/906 |
| 5,058,236 | 10/1991 | Henson | 16/238 |
| 5,463,795 | 11/1995 | Carlson et al. | 16/273 |
| 5,577,295 | 11/1996 | Papke et al. | 16/386 |

FOREIGN PATENT DOCUMENTS

| | | | |
|---|---|---|---|
| 472422 | 6/1946 | Canada . | |
| 754291 | 3/1967 | Canada . | |
| 17276 | 9/1894 | United Kingdom | 16/244 |

*Primary Examiner*—Chuck Mah
*Assistant Examiner*—Donald M. Gurley
*Attorney, Agent, or Firm*—Murray E. Thrift; Adrian D. Battison

[57] ABSTRACT

An adjustable gate latch has a striker bar (70) and a latch component including a base (10) with a track (17). The latch assembly slides along the track (17) when engaged by a striker (70) that is out of line with the latch member (50). This automatically compensates for relative movement between the gate and the associated gate posts. An adjustable hinge (80) has one of its hinge plates (82, 84) slideable vertically on the hinge pin (90). it is biased to a centre position by a spring (92). Alternative embodiments of the hinge have the moveable hinge plate threaded onto the hinge pin.

9 Claims, 4 Drawing Sheets

HARDWARE FOR SWINGING PANELS

FIELD OF THE INVENTION

The present invention relates to a hardware component for connecting a swinging panel to an adjacent stationary component, said component comprising a first part mountable on one of the panel and the stationary component, a second part mountable on the other of the panel and the stationary component, and connecting means for connecting the first and second components.

BACKGROUND

Conventional gate and door hardware of this type, e.g. a latch or a hinge, is generally of good design and adequate for its intended purpose until the gate or door panel and the associated post or frame become misaligned, for example through ground movements or building settling. Such movements can occur seasonally. The result is misaligned panels that cannot be closed properly. In the case of a gate, damaged, broken or bent latch components may result.

The present invention is intended to ameliorate this problem.

SUMMARY

According to one aspect of the present invention there is provided hardware of the aforesaid type characterized in that the connecting means include adjustment means for adjusting the relative positions of the first and second components.

In one embodiment, the hardware is a latch for latching a swinging panel to an adjacent stationary component, in which:

the first part is a striker bar;

the second part is a base member; and the connecting means are

- a track included in the base member,
- a latch assembly including a track follower engageable in the track for movement therealong,
- a receiver mounted on the track follower and having a flared throat for receiving the striker,
- a latching member mounted moveable on the latch assembly for capturing the striker in the receiver throat, and
- resilient means for biasing the latch assembly to a neutral position along the track, such that a misaligned striker, on engaging the receiver throat will cam the receiver throat to a position in which the striker will seat in the receiver throat and be captured by the latching member.

The latch is thus self adjusting in that the striker will cam the receiver to a position where the striker may be fully seated in the receiver throat and captured by the latching member.

In another embodiment, the hardware is a hinge in which:

the first part is a first hinge plate;

the second part is a second hinge plate; and the connecting means are:

- at least two aligned, spaced apart first knuckles on the first hinge plate,
- a second knuckle on the second hinge plate, positioned between and aligned with the pair of first knuckles,
- the second knuckle being shorter than the spacing between the first knuckles,
- a hinge pin extending through and coupling the first and second knuckles, and

- resilient means biasing the second knuckle along the pin to a neutral position between the first knuckles.

According to this embodiment of the invention, the misalignment is taken up on the hinge side of the gate by relative vertical movement of the two hinge components.

In another embodiment of the invention, the hardware component is a hinge in which;

the first part is a first hinge plate;

the second part is a second hinge plate;

the connecting means are:

- first knuckle means on the first hinge plate and including
  - at least two aligned first knuckles spaced apart along a hinge axis, each first knuckle having an internal threaded bore arranged coaxially with the hinge axis;
- second knuckle means on the second hinge plate and including
  - at least one second knuckle aligned with and positioned between the first knuckles of the first plate,
  - the second knuckle being shorter than the spacing between the first knuckles,
  - two internal, substantially cylindrical bearing surfaces arranged coaxially with the hinge axis, and internal pin supporting means; and
- two hinge pins extending through respective ones of the first knuckles and into the second knuckle means and joining the hinge plates for relative rotation about the hinge axis, each hinge pin having
  - a threaded section engaged with the threaded bore in a respective one of the first knuckles,
  - a cylindrical bearing section engaging rotatably in a respective bearing surface of the second knuckle means, and
  - an axially facing knuckle engaging end engaging the internal engaging the pin supporting means of the second knuckle means.

Both hinge pins must be adjusted to adjust this hinge. The internal pin supporting means are preferably ball bearings on which the ends of the pins are seated. This embodiment may be molded from a plastics material. The adjustment is this case is fixed, so that the gate does not "float" as it does with the resiliently supported hinge arrangement.

In a further embodiment of the invention, the hardware is a hinge in which;

the first part is a first hinge plate;

the second part is a second hinge plate;

the connecting means are:

- first knuckle means on the first hinge plate and including
  - at least two aligned first knuckles spaced apart along a hinge axis, each first knuckle having an internal, substantially cylindrical bearing surface arranged coaxially with the hinge axis, and
  - at least two axially facing pin supporting surfaces;
- second knuckle means on the second hinge plate and including
  - at least one second knuckle aligned with and positioned between the first knuckles of the first plate, the second knuckle being shorter than the spacing between the first knuckles,
  - at least one internal, substantially cylindrical bearing surface arranged coaxially with the hinge axis, and an internally threaded section; and
- a hinge pin extending through the knuckles and joining the hinge plates for relative rotation about the hinge axis, the hinge pin having a plurality of substantially cylindrical bearing sections engaged rotatably with the substantially cylindrical bearing surfaces of the respective knuckles, at least two axially facing knuckle engaging surfaces engaging the pin supporting surfaces of the first knuckle means, and a threaded section threaded into the threaded section of the second knuckle means.

A conventional door hinge is designed with five knuckles. This always provides two bearing surfaces on the jamb plate knuckles to take the door load. This has been found to be desirable in order to prevent excessive wear. With an adjustable hinge, it is of importance to maintain this load distribution on the jamb plate. However, because the knuckles do not rest on one another, this prior art load distribution technique is not available. With the present embodiment, the load is transmitted to the jamb plate by the hinge pin. With two bearing surfaces on the pin, and corresponding bearing surfaces on the jamb plate, an adequate distribution of this load is provided.

In preferred embodiments, a low friction washer, e.g. of nylon or some other low friction material, is placed below the pin head and a similar low friction bushing caps the bottom end of the pin. The washer and bushing act as the bearing surfaces, and substantially outlet a metal to metal contact.

The use of an internal, substantially cylindrical bearing surface on the second knuckle means engaging the hinge pin supports both of the plates on the pin by smooth, cylindrical mating sections of the knuckles and the pin. This provides the required lateral support to the door plate without stressing the threads and causing their premature failure.

The threads may be "locked" by a rotation-resisting element, for example a nylon insert in the threaded part of the pin. This ensures that none of the normal rotation of the hinge takes place along the threaded section of the pin and the mating knuckle.

BRIEF DESCRIPTION OF THE DRAWING

In the accompanying drawings, which illustrate exemplary embodiments of the present invention.

DETAILED DESCRIPTION OF THE CLAIMS

Figure 1:
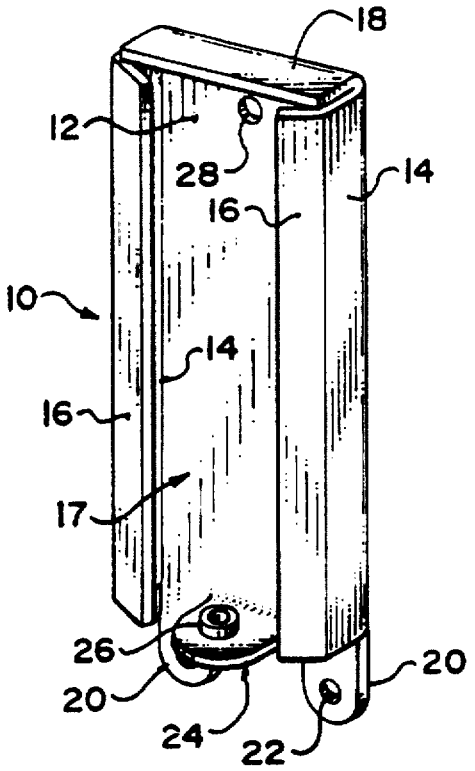
FIG. 1 is an isometric view of a latch base member.
Figure 3:
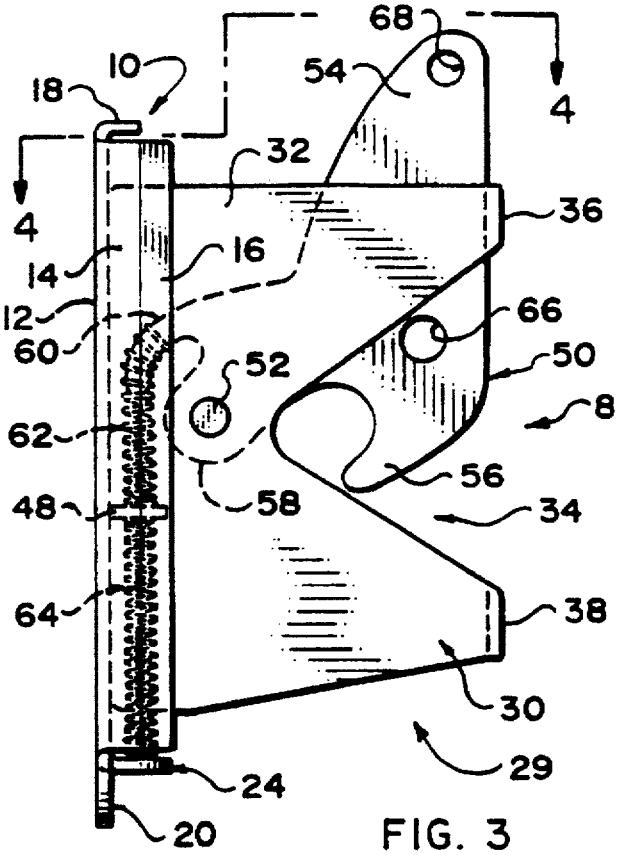
FIG. 3 is a side view of a latch assembly.
Figure 4:
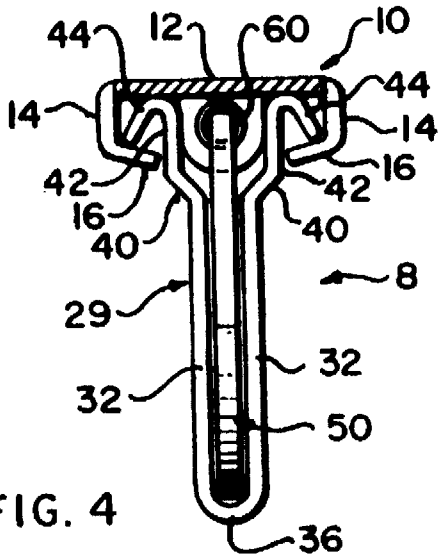
FIG. 4 is a view along line 4—4 of FIG. 3.
Figure 8:
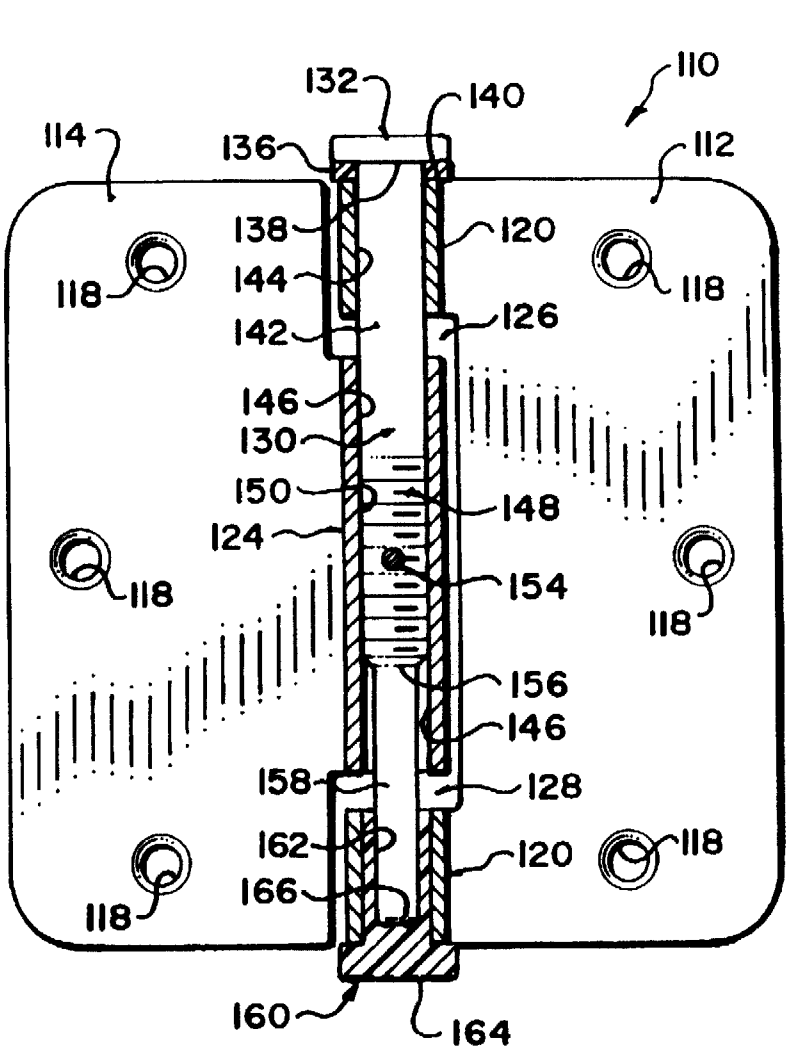
FIG. 8 is a view like FIG. 7 with the knuckles shown in cross section.
Figure 7:
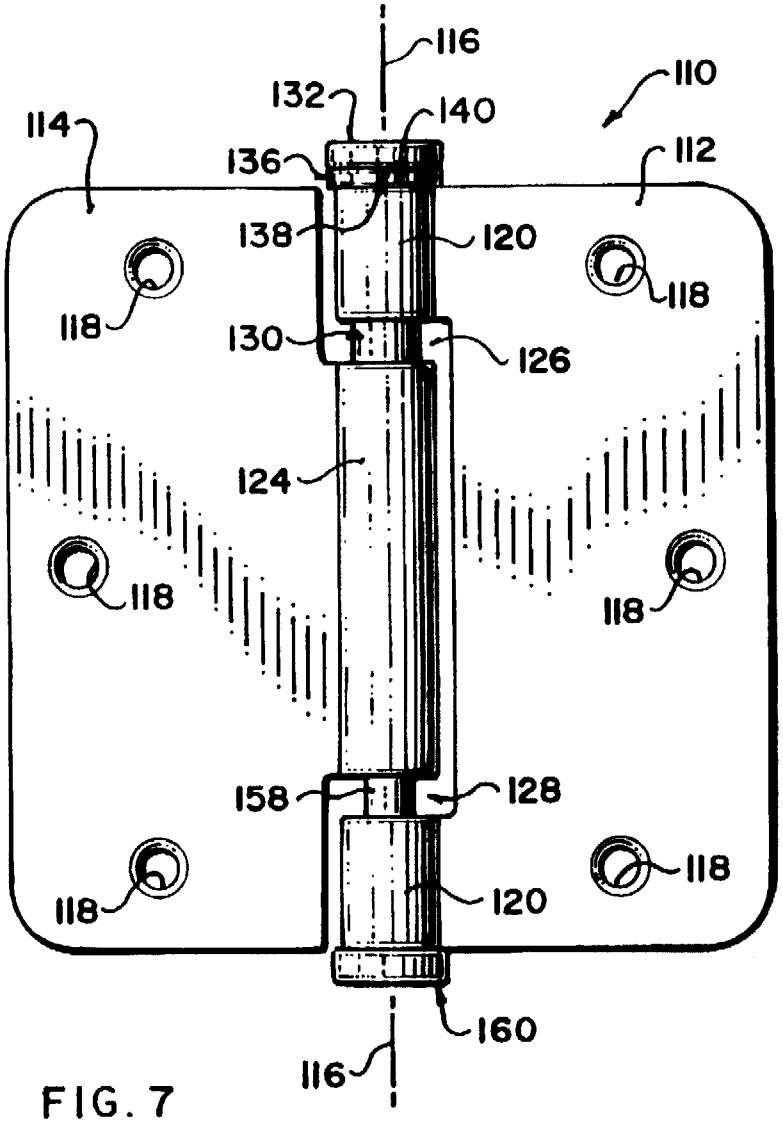
FIG. 7 is a front view of an alternative hinge.
Figure 9:
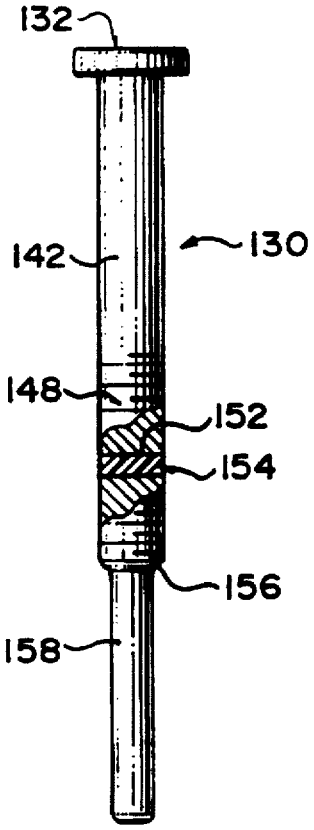
FIG. 9 is a side view of the hinge pin, partially broken away to show an insert.
Figure 10:
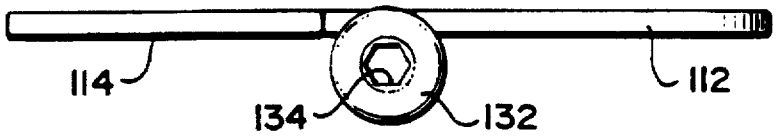
FIG. 10 is a top view of the hinge.
Figure 11:
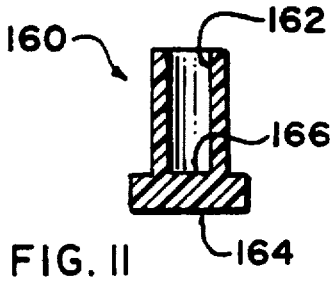
FIG. 11 is a cross section of a bushing for the lower knuckle.

Referring to the accompanying drawings, there is illustrated in FIGS. 3 and 4, a self-adjusting gate latch 8. This includes a base 10 illustrated most particularly in FIG. 1. The base includes a back plate 12 and two, spaced apart side flanges 14 projecting forwardly from the side edges of the back plate. Two lips 16 extend along the front edges of the flanges 14 and slope outwards towards one another to overlie the front of the back plate. The back plate 12, the flanges 14 and the lips 16 thus provide a track 17 extending from end to end of the base plate.

The top end of the track 17 is closed by an end flange 18. At the bottom edge, the base plate 12 has two mounting lugs 20, with screw holes 22. A third lug 24 projects to the front and carries a boss 26 on its top face.

Figure 2:
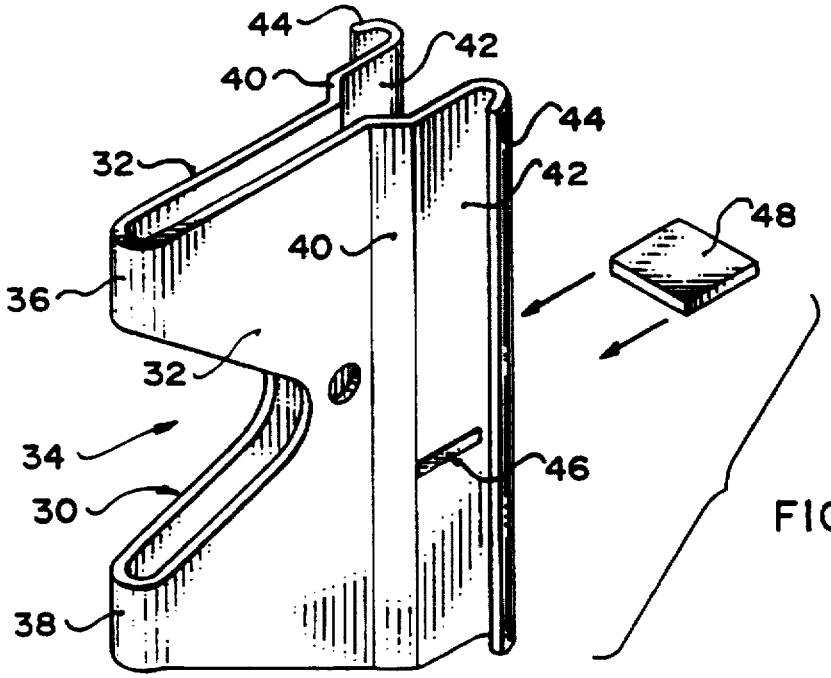
FIG. 2 is an isometric view of a latch receiver.

Another mounting screw hole 28 is located at the top of the base plate. A latch assembly 29 is illustrated in FIGS. 3 and 4. The latch assembly includes a receiver 30 (FIG. 2) with parallel side plates 32 configured to provide an outwardly flaring throat 34. The side plates are joined by two front webs 36 and 38. At the back of each side plate, is an offset 40 leading to an edge flange 42. The back edge of each flange 42 curves outwardly and to the front as a curved lip 44. These lips engage between the lips 16 and base plate 12 so that the receiver 30 will slide in the track 17 of the base. The flanges 42 have aligned slots 46 that engage the side edges of a spring support plate 48.

The receiver carries a latching member 50 in the form of a lever mounted on the receiver, between its side plates, by a cross pin 52. The latching member has an upper arm 54 projecting outwardly and upwardly above the receiver throat 34, and a tongue 56 projecting downwardly from the upper arm across the throat. A rear arm 58 extends to the back of the receiver throat for connection to the cross pin 52. A further spring retainer arm 60 projects to the rear and down from above the cross pin 52 to engage in the upper end of a coil spring 62. The lower end of the spring is seated on the plate 48. The spring biases the latching member to the latching position illustrated in FIG. 3. A second spring 64 extends between lug 24, where it engages boss 26, to plate 48, thus supporting the latch assembly in a neutral position, partway along the track 17.

The latching member 50 has a lock hole 66 for locking the latch with a padlock. A hole 68 in the upper arm 54 is used for attaching a rope or the like for opening the latch from another location, for example on the outside of a gate.

Figure 5:
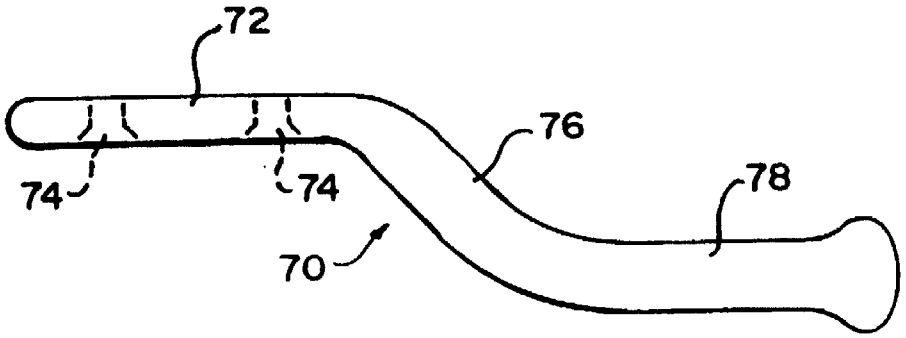
FIG. 5 is a top view of a striker bar.

A striker bar 70 for the latch is illustrated in FIG. 5. This includes a mounting end 72 with two holes 74 for mounting screws, an off-set centre section 76 and a straight striker end 78 that engages in the receiver throat 34 and cams the tongue 56 of the latching member upwardly so that the striker bar may engage fully in the throat. The latching member tongue drops outside of the striker bar to capture it in the receiver throat.

In use, the latch assembly is assembled into the base and is supported in a neutral position half-way along the track 17. The base is mounted on the gate post in most instances, with the striker bar being mounted on the adjacent gate to engage centrally in the receiver throat when the gate is closed. In the event of any misalignment of the striker and the latch, the striker bar will engage the top or bottom side of the flared receiver throat and will cam the latching member either up or down in the track 17 until the striker bar seats fully in the throat and the latching member 50 falls into place behind it.

Figure 6:
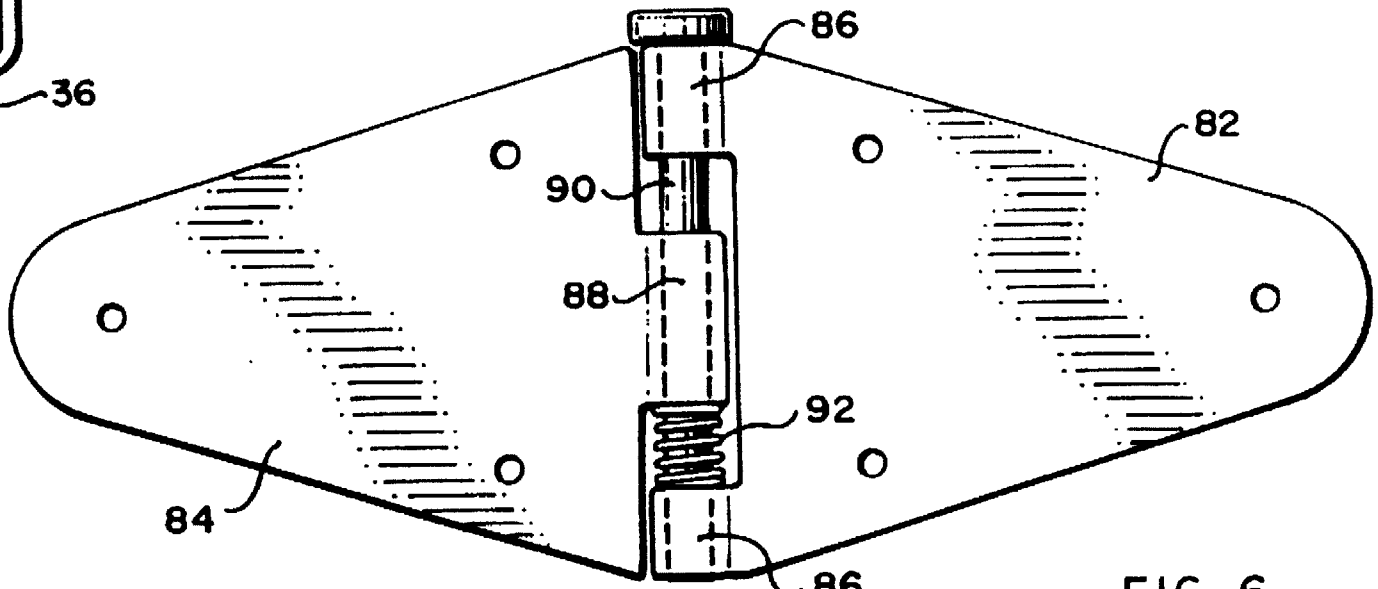
FIG. 6 is a front view of a hinge.

FIG. 6 illustrates an automatically adjusting hinge 80 for a gate. The hinge includes two plates 82 and 84. The plate 82 has two aligned, spaced knuckles 86, while the plate 84 has a single knuckle 88 aligned with the knuckles 86 and located between them. The knuckle 88 is significantly shorter than the distance between the two knuckles 86. A hinge pin 90 extends through all three knuckles and holds them together.

A compression spring 92 surrounds the pin 90 between the knuckle 88 and the lowermost knuckle 86 to bias the knuckle 88 to a neutral position between the knuckles 86. This hinge will accommodate vertical movements of the hinge plate 84 along the hinge pin to compensate for misalignments of the gate post.

An alternative embodiment of hinge is illustrated in FIGS. 7 to 11. This hinge 110 includes a jamb plate 112 and a door plate 114. These are coupled to rotate on a hinge axis 116. Each plate is provided with conventional screw holes 118 that are used for mounting the plates on a jamb and a door respectively.

The jamb plate 112 is equipped with two knuckles 120. These are spaced apart along the hinge axis 116. Interposed between the knuckles 120 is a knuckle 124 mounted on the door plate 114. The knuckle 124 is shorter in length than the space between the knuckles 120 so that spaces 126 and 128 are provided above and below the knuckle 124 providing room for its adjustment up and down.

The three knuckles are joined by a hinge pin 130 that extends through the three knuckles. The pin has an enlarged head 132 at the upper end. The upper end of the pin has a socket 134 for engagement with a rotating tool, in this case an allen key.

Immediately below the pin head 132 is a low friction nylon washer 136. This engages between the support surface 138 under the pin head and the support surface 140 at the top end of the upper knuckle 120.

The pin 130 has an upper cylindrical bearing section 142 that fits rotatably into the inner cylindrical surface 144 of the upper knuckle 120 and the inner cylindrical surface 146 of the centre knuckle 124. Below the cylindrical bearing section 142, the pin has a threaded section 148 that engages an internally threaded section 150 at the middle of the centre knuckle 124. The threaded engagement of the pin with the threaded section 150 of the knuckle provides for travel of the knuckle up and down on the pin as the pin is rotated in the knuckle. The arrangement is such that any adjustment will not result in thread exposure. A transverse bore 152 extends through the threaded section of the pin 130 and holds a nylon insert 154 projecting into the threads on opposite sides of the pin. This insert is engaged by the threads on the knuckle 124 and deformed by them to resist relative rotation of the pin in the knuckle. At the same time, the resistance to rotation is not so high as to prevent the rotation of the pin with a tool engaging the socket 134 in the head.

Below the threaded section 148, pin 130 has a step 156 leading to a lower cylindrical bearing section 158. This lower cylindrical bearing section engages rotatably in a bushing 160 fitted in and secured to the lower knuckle 120. The bushing 160 (FIG. 11) is made from a low friction nylon and has an internal cylindrical bearing surface 162 that engages the lower cylindrical section of the pin. It also has a head 164 closing the end of the bushing. An inner end face 166 of the head supports the bottom end of the pin 130 as an axially facing support surface.

In use of this hinge, the bushing 160 and the washer 136 act as two separate support surfaces for the hinge pin 130. The load on the pin is thus transmitted to the support surfaces 140 and 166. The load from the door plate is transmitted to the hinge pin through the threaded sections of the door plate knuckle and the pin. Because of the engagement of the cylindrical pin surface with the cylindrical inner surface of the centre knuckle, the load transmitted through the threads is primarily axial and the threads do not need to resist the radial forces and bending moments applied to the pin. When the position of the door plate 114 must be adjusted with respect to the jamb plate 112, an appropriate tool is engaged in the socket 134 in the pin head and the pin is rotated with respect to the door plate. This will either raise or lower the door plate on the hinge pin, providing the necessary adjustment.

In the illustrated embodiment, the bushing 160 is secured in the lower knuckle 120 by being pressed in place and fastened with a commercial adhesive providing a shear strength in excess of 2500 psi.

The two knuckles 120 in this embodiment are identical, and the threads 150 are centred in the knuckle 124, so that right and left hand hinges are the same with the only difference being which of knuckles 120 carries the bushing 164. Installation of the bushing may, where desired, be left to the installer.

Figure 12:
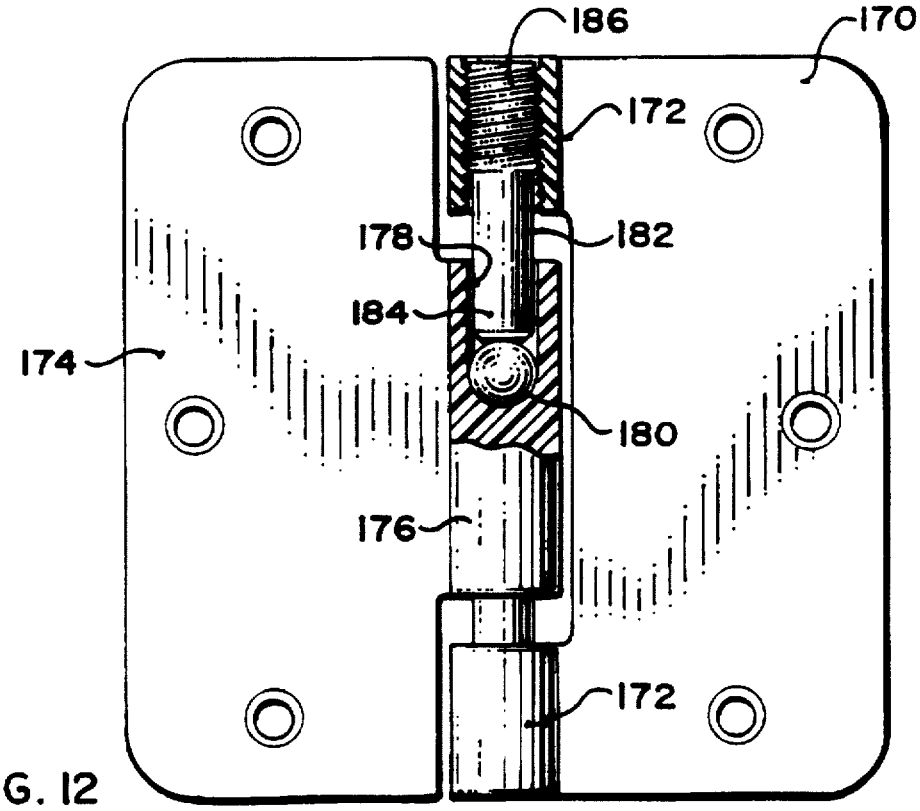
FIG. 12 is an exploded view, partially broken away, of another embodiment of hinge.

Another embodiment of the hinge is illustrated in FIG. 12. In that embodiment, the jamb plate 170 has two knuckles 172 that are internally threaded. The door plate 174 has a centre knuckle 176 with a blind bore 178 extending into the knuckle from either end. Seated in the bottom of each blind bore is a ball bearing 180. Two hinge pins 182 have cylindrical inner ends 184 and threaded outer ends 186. The pins are inserted into the respective knuckles 172 to project into the bores of the centre knuckle. The ends of the hinge pins ride on the ball bearings to support the centre knuckle in place. In this embodiment, the two hinge pins must be adjusted to provide the desired door adjustment. The hinge plates and knuckles of this embodiment are preferably manufactured of injection molded, reinforced plastic. This embodiment of the hinge is symmetrical and can be used for either right hand or left hand applications.

While particular embodiments of the present invention have been described in the foregoing, it is to be understood that other embodiments are possible within the scope of the invention. For example, a hinge with more than three knuckles could be constructed. In a hinge with a threaded adjustment, the particular configuration of the thread may be selected according to the needs of a particular hinge design. It may be desirable in some embodiments to use a power screw thread profile, for example square, Acme or buttress in order to provide added strength.

I claim:

1. A hinge for connecting a swinging panel to an adjacent stationary component, said hinge comprising:

a first hinge plate mountable on the stationary component;

a second hinge plate mountable on the panel;

first knuckle means on the first hinge plate and including at least two aligned first knuckles spaced apart along a hinge axis, the first knuckles having internal, substantially cylindrical bearing surfaces of the same diameter and arranged coaxially with the hinge axis, and respective pin supporting surfaces facing in opposite axial directions;

second knuckle means on the second hinge plate and including at least one second knuckle aligned with and positioned between the first knuckles of the first plate, the second knuckle being shorter than the spacing between the first knuckles, two axially spaced apart internal, substantially cylindrical bearing surfaces arranged coaxially with the hinge axis, and an internally threaded section between said two substantially cylindrical bearing surfaces;

a hinge pin extending through the knuckles and joining the hinge plates for relative rotation about the hinge axis, the hinge pin having a first substantially cylindrical bearing section engaged rotatably with the substantially cylindrical bearing surface of one of the first knuckles, a second sustantially cylindrical bearing surface positioned within the other of the first knuckles, a third substantially cylindrical bearing surface engaged rotatably with one of said two bearing surfaces of the second knuckle, an axially facing knuckle engaging surface engaging the pin supporting surface of said one of the first knuckles, and a threaded section threaded into the threaded section of the second knuckle means; and a bushing secured in said other of the first knuckles, the bushing having a closed end engaging an end of the pin and a substantially cylindrical bearing surface engaged rotatably with the second substantially cylindrical bearing surface of the pin.

2. A hinge according to claim 1 wherein the threaded section of the pin is enclosed within the second knuckle means.

3. A hinge according to claim 1 including pin restraint means engaging the pin with the second knuckle means to restrain rotation of the pin in the second knuckle means.

4. A hinge according to claim 3 wherein the pin restraint means comprise a friction element engaged with the threaded section of one of the pin and the second knuckle means.

5. A hinge according to claim 1 wherein the hinge pin is a stepped pin with a head at one end, the head comprising the axially facing knuckle engaging surface of the pin.

6. A hinge according to claim 5 wherein the pin head is configured to be engaged by a rotating tool.

7. A hinge according to claim 5 including bearing means between the head of the pin and an adjacent end of the first knuckle means.

8. A hinge according to claim 7 wherein the bearing means comprise a low friction washer.

9. A hinge according to claim 1 wherein the bushing is engageable in either of the two first knuckles.

* * * * *